US012419422B2

(12) United States Patent
Zhang

(10) Patent No.: US 12,419,422 B2
(45) Date of Patent: Sep. 23, 2025

(54) FOLDING CHAIR

(71) Applicant: Ninghai Jiarun Hardware Co., Ltd., Zhejiang (CN)

(72) Inventor: Zhenguo Zhang, Zhejiang (CN)

(73) Assignee: Ninghai Jiarun Hardware Co., Ltd., Ningbo (CN)

( * ) Notice: Subject to any disclaimer, the term of this patent is extended or adjusted under 35 U.S.C. 154(b) by 162 days.

(21) Appl. No.: 18/381,617

(22) Filed: Oct. 18, 2023

(65) Prior Publication Data

US 2025/0107625 A1 Apr. 3, 2025

(30) Foreign Application Priority Data

Sep. 28, 2023 (CN) ..... 202322669682.2

(51) Int. Cl.
*A47C 4/28* (2006.01)
*A47C 4/30* (2006.01)

(52) U.S. Cl.
CPC ..... *A47C 4/286* (2013.01); *A47C 4/30* (2013.01)

(58) Field of Classification Search
CPC .. A47C 4/286; A47C 4/30; A47C 4/34; A47C 4/44
See application file for complete search history.

(56) References Cited

U.S. PATENT DOCUMENTS 11,439,238 B1 * 9/2022 Wang ..... A47C 4/286
11,700,943 B1 * 7/2023 Wang ..... A47C 4/286 297/16.2
11,871,848 B1 * 1/2024 Wang ..... A47C 4/286

* cited by examiner

*Primary Examiner* — Milton Nelson, Jr.

(57) ABSTRACT

A folding chair includes an upper connector, a lower connector, a plurality of upper connecting rods, a plurality of lower connecting rods and a chair cloth, a plurality of cloth corners of the chair cloth being connected to free ends of the upper connecting rods respectively. The lower connector has a same number of lower open slots as the number of the lower connecting rods, and the lower open slot is provided with a stop protrusion and provided with a positioning portion. The lower connecting rod includes a rod body and a stopper elastically installed on an upper end of the rod body. When the folding chair is in an unfolded state, a slope of an upper end of the stopper abuts against a sidewall of the stop protrusion. When the folding chair is in a folded state, a top end of the stopper is clamped into the positioning portion.

10 Claims, 15 Drawing Sheets

FOLDING CHAIR

CROSS REFERENCE TO RELATED APPLICATIONS

The present application claims the benefit of Chinese Patent Application No. 2023226696822 filed on Sep. 28, 2023, the contents of which are incorporated herein by reference in their entirety.

TECHNICAL FIELD

The present disclosure relates to the technical field of chairs, and more particularly relates to a folding chair.

BACKGROUND

Outdoor folding chairs are outdoor furniture with powerful functions and convenient to take along. They are concisely designed, and of a folding function, so that users can easily pack them up or take them long for outdoor activities. The outdoor folding chairs are usually made of durable and light materials, such as aluminum alloy or reinforced plastic, allowing them to achieve double advantages of durability and portability.

In existing folding chairs, at least three lower connecting rods are connected to a lower connector as support legs. The lower connecting rod adopts a hollow pipe structure. When the folding chair is unfolded, an edge of an upper end of the lower connector abuts against a sidewall of an upper connector. Stress is concentrated near an edge of the lower connector, and use for a long time easily results in edge deformation, affecting the use.

SUMMARY

The present disclosure aims to solve one of the technical problems in related technologies to a certain extent. Therefore, the present disclosure proposes a folding chair.

A technical solution adopted by the present disclosure is that: a folding chair is provided, including an upper connector, a lower connector, a plurality of upper connecting rods connected to the upper connector, a plurality of lower connecting rods connected to the lower connector and a chair cloth, a plurality of cloth corners of the chair cloth being connected to free ends of the upper connecting rods respectively, where the lower connector has a same number of lower open slots as the number of the lower connecting rods, and the lower open slot is provided with a stop protrusion in a protuberant manner and provided with a positioning portion in a depressing manner inside, the lower connecting rod includes a rod body and a stopper elastically installed on an upper end of the rod body, when the folding chair is in an unfolded state, a slope of an upper end of the stopper abuts against a sidewall of the stop protrusion, and when the folding chair is in a folded state, a top end of the stopper is clamped into the positioning portion.

In the above structure, the upper connecting rod is rotatably installed on the upper connector, and the lower connecting rod is rotatably installed on the lower connector. The stopper and the positioning portion are provided, so that the stopper and the rod body form an elastic snap structure, and when the folding chair is in a folded state, the stopper is clamped into the positioning portion to force the lower connecting rod to remain in position. By rotating the lower connecting rod to achieve a forced disengagement of the stopper and the positioning portion, so that the plurality of lower connecting rods are unfolded for use as chair legs. Compared to the prior art, the present disclosure adds the stopper on the upper end of the rod body, and adds the stop protrusion abutted against by the stopper on the lower connector, so that stress is concentrated on the contact position between the slope of the upper end of the stopper and the sidewall of the stop protrusion, and increase of contact area is less prone to deformation, thereby improving the bearing capacity of the folding chair, and prolonging the service life.

According to an embodiment of the present disclosure, the lower connecting rod further includes a hollow connecting arm, the connecting arm is embedded into the rod body, and the stopper is installed in the connecting arm in a slidable manner. The connecting arm is provided, so that an upper half part, in contact with the upper connector, of the upper connecting rod is of a double-layer structure, further improving the strength and stability of the connecting rod. Such a structural design can ensure that the connecting rod can bear a larger force during use, reducing the risk of possible deformation or rupture.

According to an embodiment of the present disclosure, the rod body is provided with a first stop pin, and the first stop pin runs through the connecting arm, a spring is provided between a part of the first stop pin inside the connecting arm and the stopper. Provision of the spring achieves elastic installation of the stopper.

According to an embodiment of the present disclosure, the rod body is provided with a second stop pin, and the second stop pin runs through the connecting arm, the stopper is transversely formed with a strip-type slide hole, a part of the second stop pin inside the connecting arm is in slidable cooperation with the strip-type slide hole. Provision of the strip-type slide hole can be used for controlling the moving range of the connecting arm.

According to an embodiment of the present disclosure, the upper connector is provided with an upper center hole, the lower connector is provided with a lower center hole, and a connecting shaft runs through the upper center hole and the lower center hole, realizing fixed connection or rotatable connection between the upper connector and the lower connector. When the upper connector is fixedly connected to the lower connector, positions of them are relatively fixed. When the upper connector is rotatably connected to the lower connector, the upper connector and the chair cloth above it can rotate relative to the lower connector, and the chair can be used as a rotating chair.

According to an embodiment of the present disclosure, the lower connecting rod is provided in pair, and each pair of the lower connecting rods is symmetrically distributed with the connecting shaft as a symmetric axis. The above provision can well disperse and absorb the pressure borne by the lower connecting rod, slopes of two stoppers abut against a sidewall of the stop protrusion, the lower center hole of the stop protrusion is filled with a lower shaft sleeve and a main bolt, and three form a solid structure in combination, improving the structural strength.

According to an embodiment of the present disclosure, a first immediate connector is provided between the upper connector and the lower connector, the first immediate connector includes an upper shaft sleeve connected to the upper connector and a lower shaft sleeve connected to the lower connector, the upper shaft sleeve is configured to rotate relative to the lower shaft sleeve, and the connecting shaft runs through the upper shaft sleeve and the lower shaft sleeve. Compared to use of a bearing in a conventional rotating and folding chair design, provision of the first immediate connector can provide more stable and durable connection. The bearing may incur wear after use for a long time, resulting in insecure connection. The provision of the first immediate connector can solve this problem, achieving more stable connection. The first immediate connector is entirely made of plastic, with high abrasion resistance and corrosion resistance. Due to such a type of design, no contact will occur between metals, resulting in little friction and reduction of importance in heat dissipation.

According to an embodiment of the present disclosure, the upper shaft sleeve includes an upper flange disk and a first shaft sleeve column formed by protrusion of the upper flange disk, the first shaft sleeve column is in rotatable cooperation with the upper center hole, and the connecting shaft is adapted to the first shaft sleeve column.

According to an embodiment of the present disclosure, a side, facing to the lower connector, of the upper connector is provided with several upper positioning protrusions, and the upper flange disk is provided with upper positioning holes corresponding to the upper positioning protrusions.

According to an embodiment of the present disclosure, the lower shaft sleeve includes a lower flange disk and a second shaft sleeve column formed by protrusion of the lower flange disk, the second shaft sleeve column is in rotatable cooperation with the lower center hole, and the connecting shaft is adapted to the second shaft sleeve column.

According to an embodiment of the present disclosure, a side, facing to the upper connector, of the lower connector is provided with several lower positioning protrusions, and the lower flange disk is provided with lower positioning holes corresponding to the lower positioning protrusions.

BRIEF DESCRIPTION OF THE DRAWINGS

In order to more clearly illustrate the technical solutions in the embodiments of the present disclosure or in the prior art, the following will briefly introduce the drawings needed to be used in the description of the embodiments or the prior art. Obviously, the drawings in the following description are only some embodiments of the present disclosure. For those of ordinary skill in the art, other drawings can be obtained based on these drawings without paying creative efforts.

ILLUSTRATION ON REFERENCE NUMERALS

Figure 1:
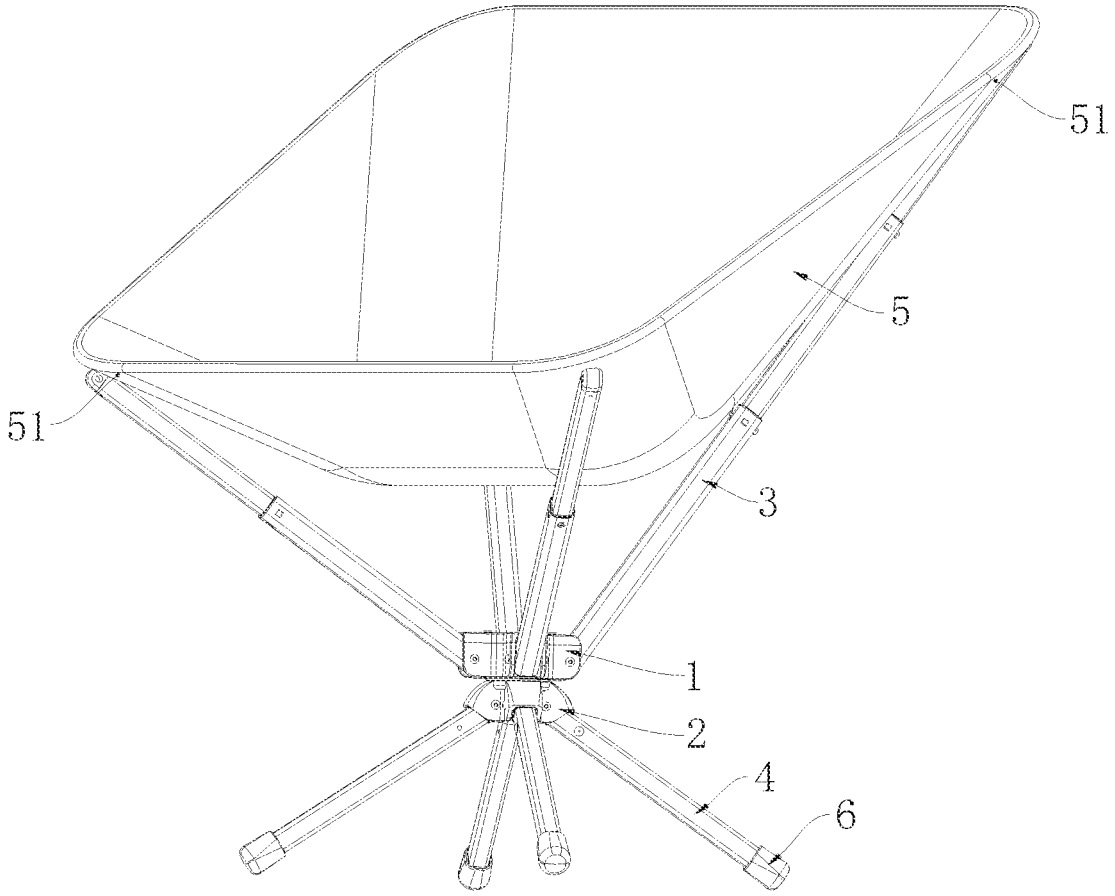
FIG. 1 is a stereogram of a folding chair in Embodiment 1 of the present disclosure.

1, upper connector; 2, lower connector; 3, upper connecting rod; 4, lower connecting rod; 5, chair cloth; 6, leg sleeve; 7, first immediate connector; 8, cover plate; 9, connecting shaft; and 10, second immediate connector;

11, upper open slot; 12, upper pivot; 13, upper center hole; and 14, upper positioning protrusion;

21, lower open slot; 22, stop protrusion; 23, lower center hole; 24, sunken slot; and 25, lower positioning protrusion;

21*a*, positioning portion; and 22*a*, sidewall;

31, free end;

41, rod body; 42, connecting arm; 43, spring; 44, stopper; 45, first stop pin; and 46, second stop pin;

44*a*, strip-type slide hole; 44*b*, slope; and 44*c*, top end;

51, cloth corner;

71, upper shaft sleeve; and 72, lower shaft sleeve;

71*a*, upper flange disk; 71*b*, first shaft sleeve column; and 71*c*, upper positioning hole;

72*a*, lower flange disk; 72*b*, second shaft sleeve column; and 72*c*, lower positioning hole; and

91, main bolt; 92, auxiliary bolt; and 93, gasket.

DETAILED DESCRIPTION

The embodiments of the present disclosure are described in detail below. Examples of the embodiments are shown in the drawings, where the same or similar reference numerals throughout represent the same or similar elements or elements with the same or similar functions. The embodiments described below with reference to the drawings are exemplary, are only used to explain the present disclosure, and cannot be understood as limitations on the present disclosure.

Embodiment I

As shown in FIG. 1 to FIG. 12, a folding chair is disclosed in this embodiment. The folding chair is divided into three major portions in a vertical direction, i.e., a first portion includes an upper connector 1 and four upper connecting rods 3, a second portion includes a lower connector 2 and four lower connecting rods 4, and a third portion is a chair cloth 5. Four cloth corners 51 of the chair cloth 5 are connected to free ends 31 of the four upper connecting rods 3 respectively, where the upper connector 1 is located above the lower connector 2.

The upper connecting rod 3 adopts a telescopic rod design, and a maximum elongation length of two upper connecting rods 3 located on the front side is shorter than a maximum elongation length of two upper connecting rods 3 located on the rear side. In this way, the two upper connecting rods 3 on the rear side provide back support. The upper connector 1 is roughly in a cross shape, with four upper open slots 11. A lower end of the upper connecting rod 3 is hinged with two sidewalls 22*a* of the upper open slot 11 through an upper pivot 12. An upper end is sleeved with the cloth corner 51 of the chair cloth 5 as the free end 31 respectively. Similarly, the lower connector 2 is roughly in a cross shape. An upper end of the lower connecting rod 4 is hinged with an end of the lower connector 2 respectively. A lower end of a rod body 41 of the lower connecting rod 4 is sleeved with a leg sleeve 6.

Figure 7:
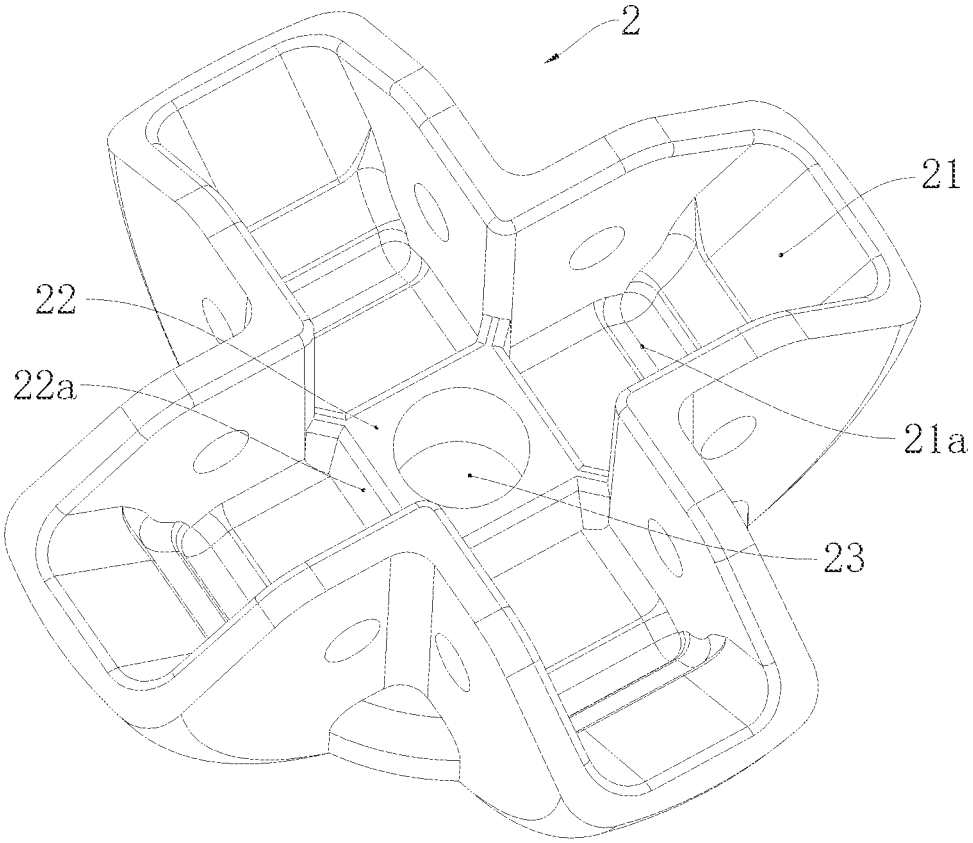
FIG. 7 is a stereogram of a lower connector in Embodiment 1 of the present disclosure.
Figure 8:
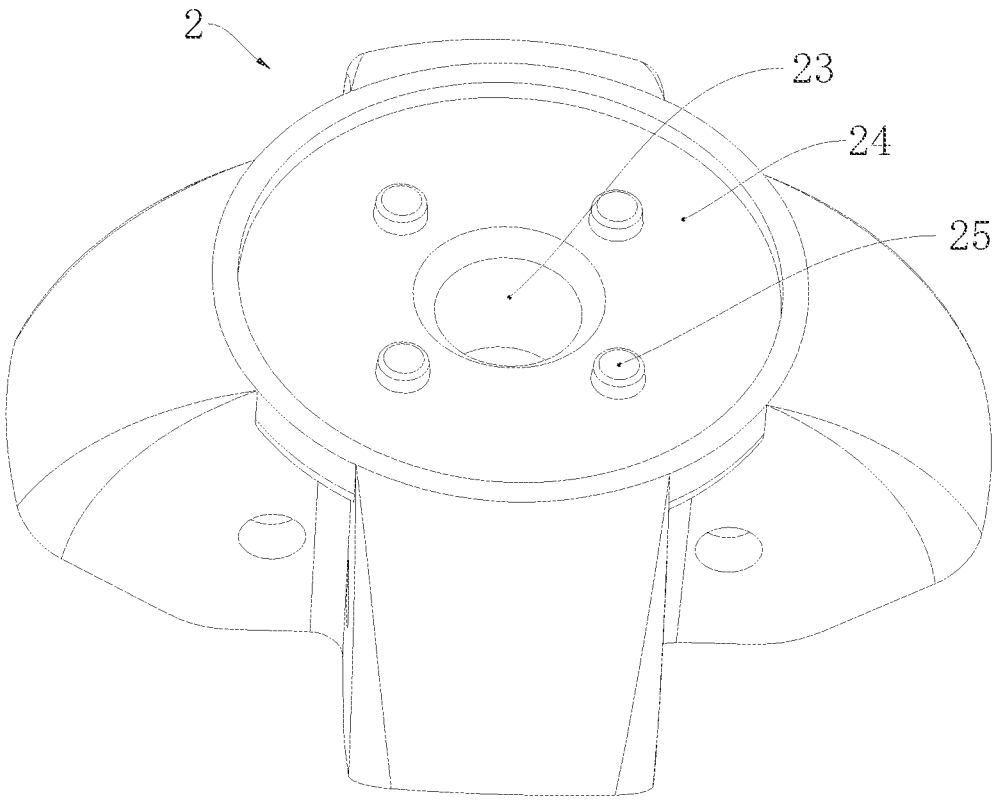
FIG. 8 is a schematic structural diagram of the lower connector in Embodiment 1 of the present disclosure.

As shown in FIG. 7 to FIG. 8, the lower connector 2 has a same number of lower open slots 21 as the number of the lower connecting rods 4, i.e., four lower open slots 21. The four lower open slots 21 form a rough cross shape in combination. The lower open slot 21 is provided with a stop protrusion 22 in a protuberant manner and provided with a positioning portion 21*a* in a depressing manner inside. The lower connecting rod 4 includes a rod body 41 and a stopper 44 elastically installed on an upper end of the rod body 41. When the folding chair is in an unfolded state, a slope 44*b* of an upper end of the stopper 44 abuts against a sidewall 22*a* of the stop protrusion 22. When the folding chair is in a folded state, a top end 44*c* of the stopper 44 is clamped into the positioning portion 21*a*.

Figure 5:
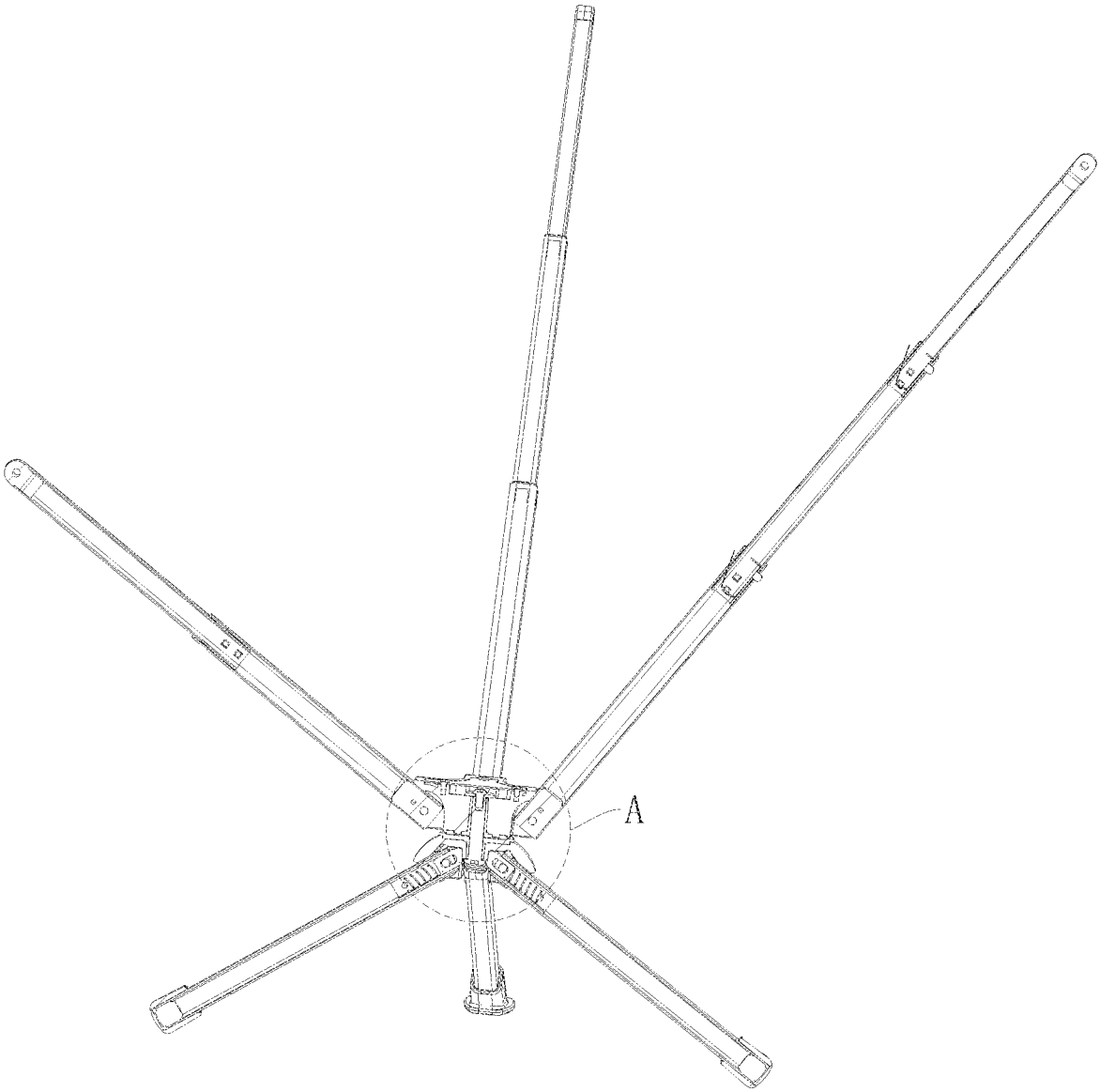
FIG. 5 is a cross-sectional view of the folding chair in Embodiment 1 of the present disclosure with a chair cloth removed.
Figure 6:
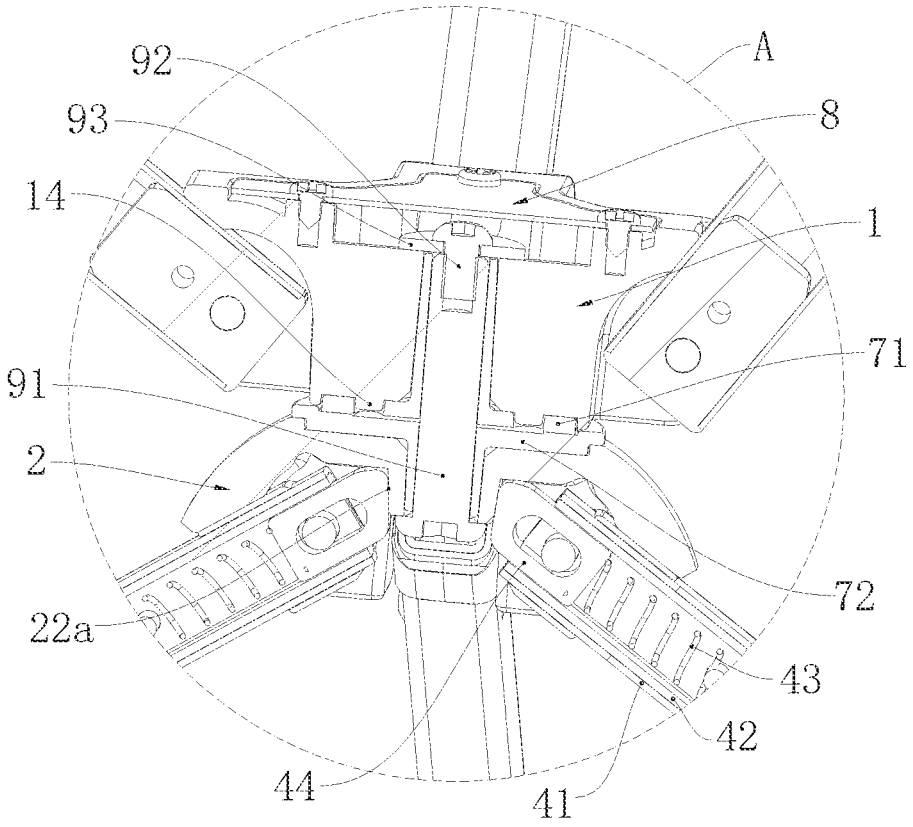
FIG. 6 is a partially enlarged view of position A in FIG. 5.

Further, in this embodiment, a center position of the lower connector 2 forms a square stop protrusion 22 downward. A center position of the stop protrusion 22 is formed with a lower center hole 23. A slot bottom of the lower open slot 21 forms the positioning portion 21*a* upon downward depression. As shown in FIG. 5 to FIG. 6, when the folding chair is in an unfolded state, the slope 44*b* of the upper end of the stopper 44 abuts against an outer sidewall 22*a* of the stop protrusion 22, and the rod body 41 of the lower connecting rod 4 abuts against an edge of the lower connector 2, thereby forming a stable support structure.

Further, in this embodiment, the stopper 44 is a solid metal part, with a strip-type slide hole 44*a* transversely provided in a transverse running manner. The strip-type slide hole 44*a* is milled out by metal processing or integrally formed by casting.

Figure 9:
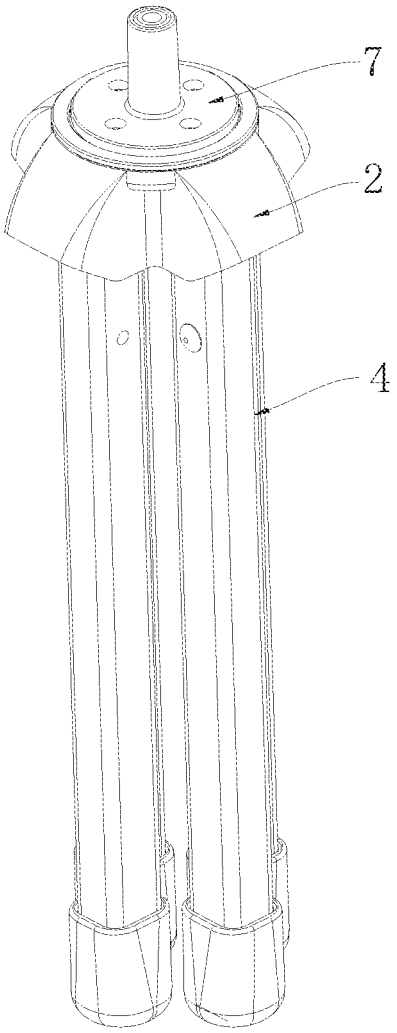
FIG. 9 is a schematic diagram of a contracted state of the folding chair in Embodiment 1 of the present disclosure with a chair cloth removed.
Figure 10:
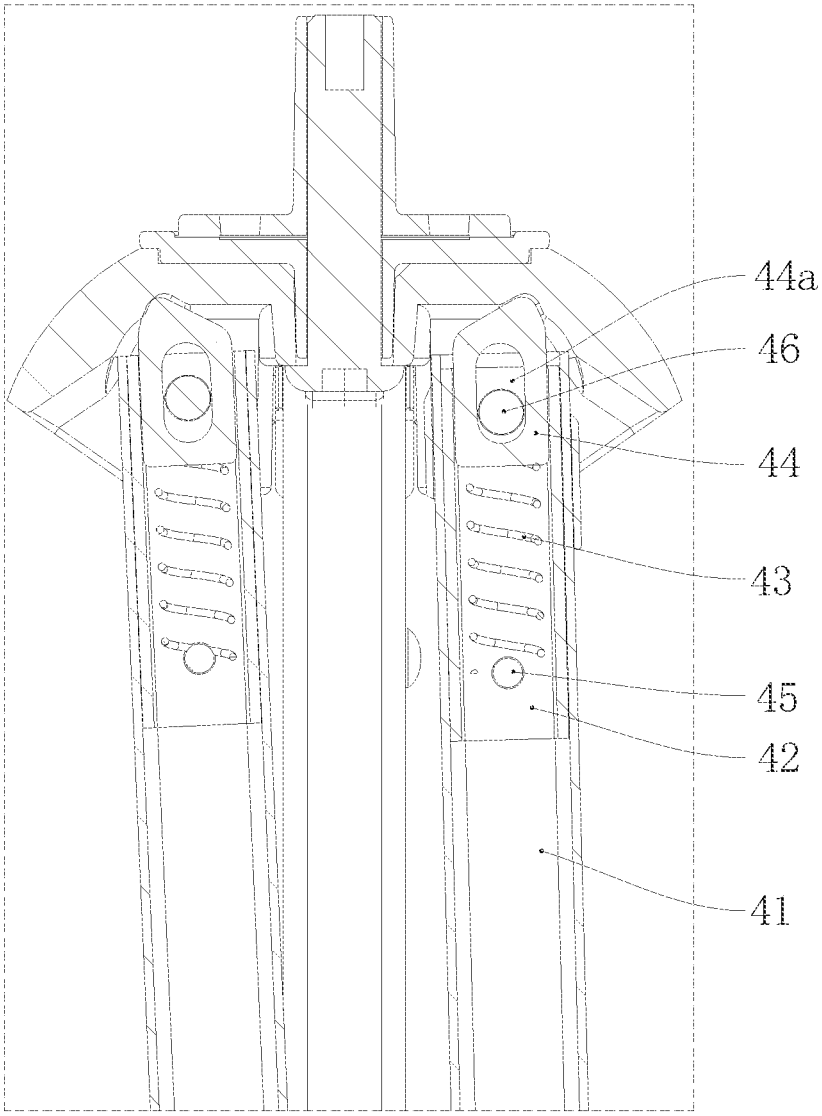
FIG. 10 is a partially cross-sectional view of the folding chair in FIG. 9.
Figure 11:
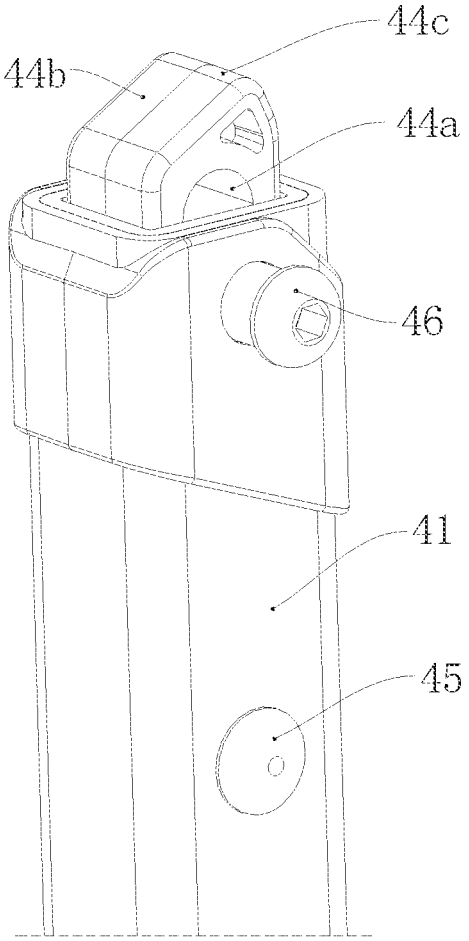
FIG. 11 is a stereogram of a lower connecting rod in Embodiment 1 of the present disclosure.

Specifically, as shown in FIG. 9 to FIG. 10, the lower connecting rod 4 further includes a hollow connecting arm 42. The connecting arm 42 is embedded into the rod body 41, and the stopper 44 is installed in the connecting arm 42 in a slidable manner. The rod body 41 is connected to a first stop pin 45, and the first stop pin 45 runs through the connecting arm 42. A spring 43 is provided between a part of the first stop pin 45 inside the connecting arm 42 and the stopper 44. The rod body 41 is provided with a second stop pin 46, and the second stop pin 46 runs through the connecting arm 42. The stopper 44 is transversely formed with a strip-type slide hole 44*a*. A part of the second stop pin 46 inside the connecting arm 42 is in slidable cooperation with the strip-type slide hole 44*a*.

Further, in this embodiment, an axial length of the connecting arm 42 is shorter than an axial length of the rod body 41, and after the connecting arm 42 is embedded into the rod body 41, an upper end of the connecting arm 42 is flush with an upper end of the rod body 41. The first stop pin 45 both transversely runs through the connecting arm 42 and the rod body 41. A lower end of the spring 43 abuts against the first stop pin 45. An upper end of the spring 43 abuts against a lower end of the stopper 44. An upper end of the stopper 44 has a slope 44*b*. The slope 44*b* has an upper edge and a lower edge, where the upper edge forms a top end 44*c* of the stopper 44 through a rounded transition.

Figure 2:
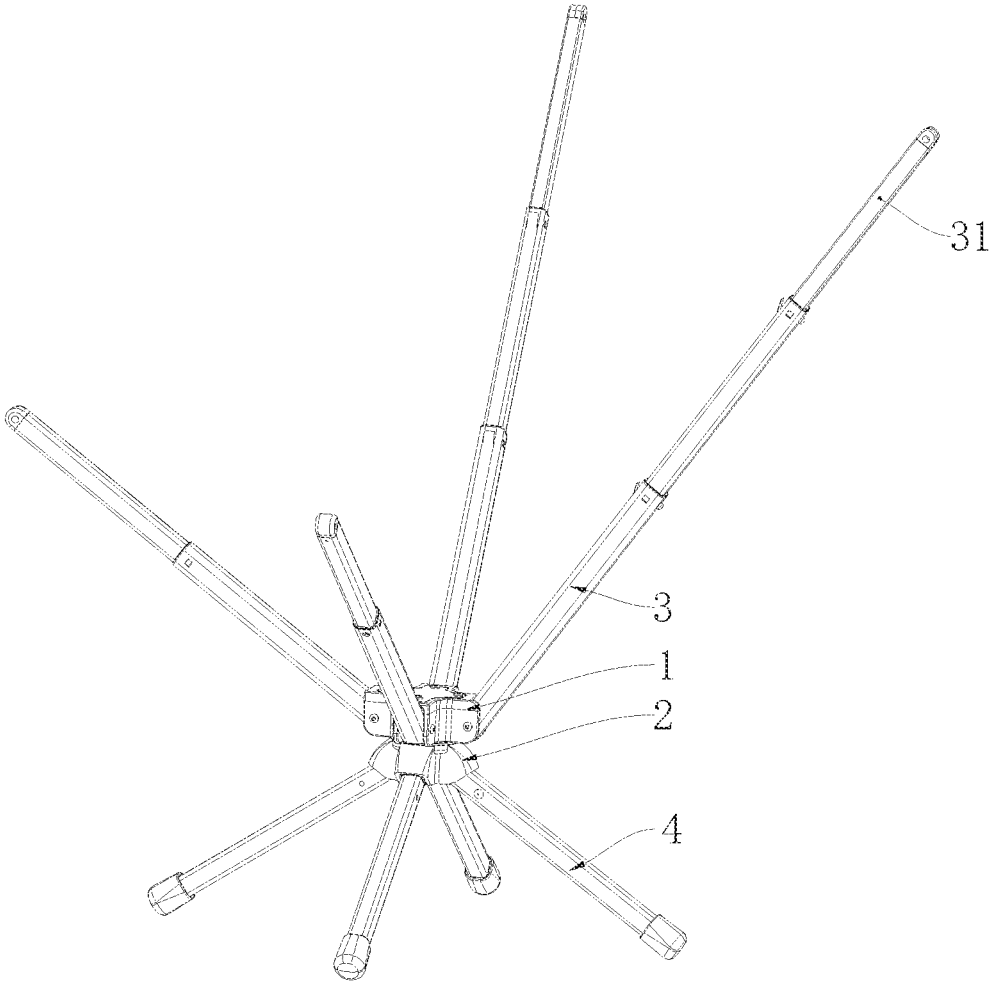
FIG. 2 is a stereogram of the folding chair in Embodiment 1 of the present disclosure with a chair cloth removed.
Figure 3:
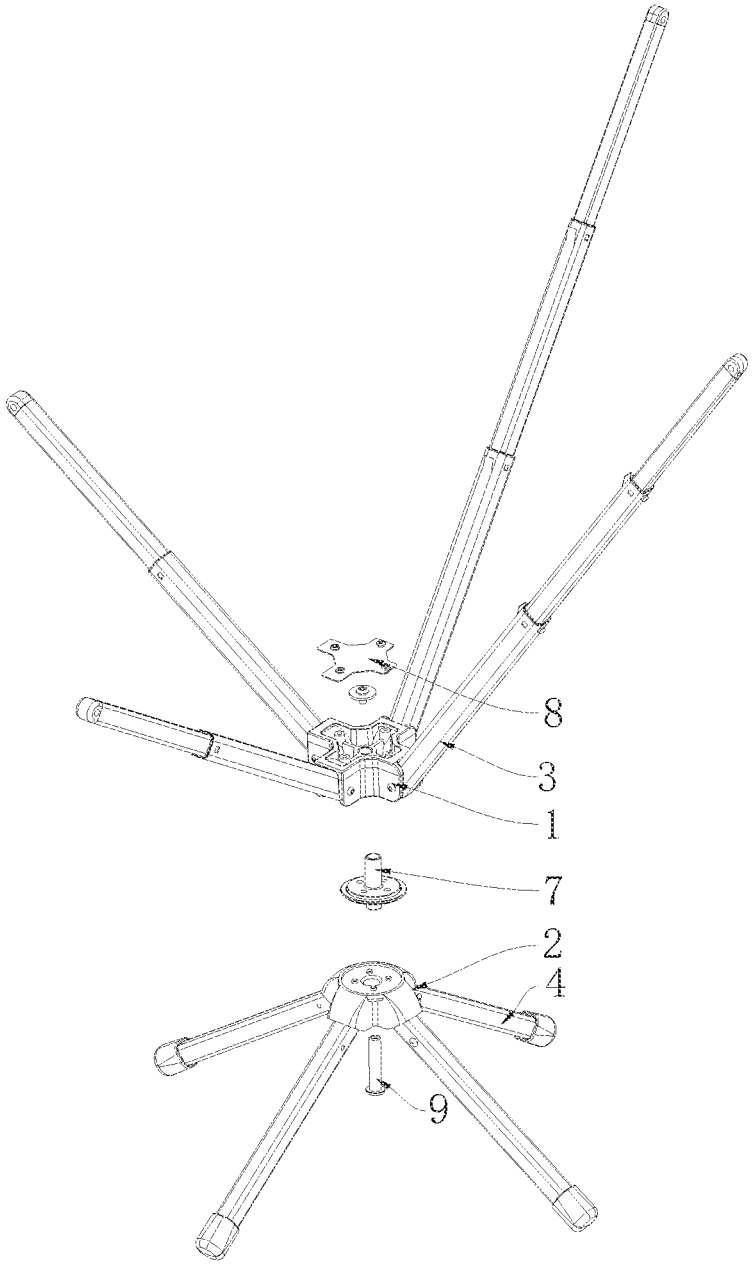
FIG. 3 is an exploded view of the folding chair in Embodiment 1 of the present disclosure with a chair cloth removed.
Figure 4:
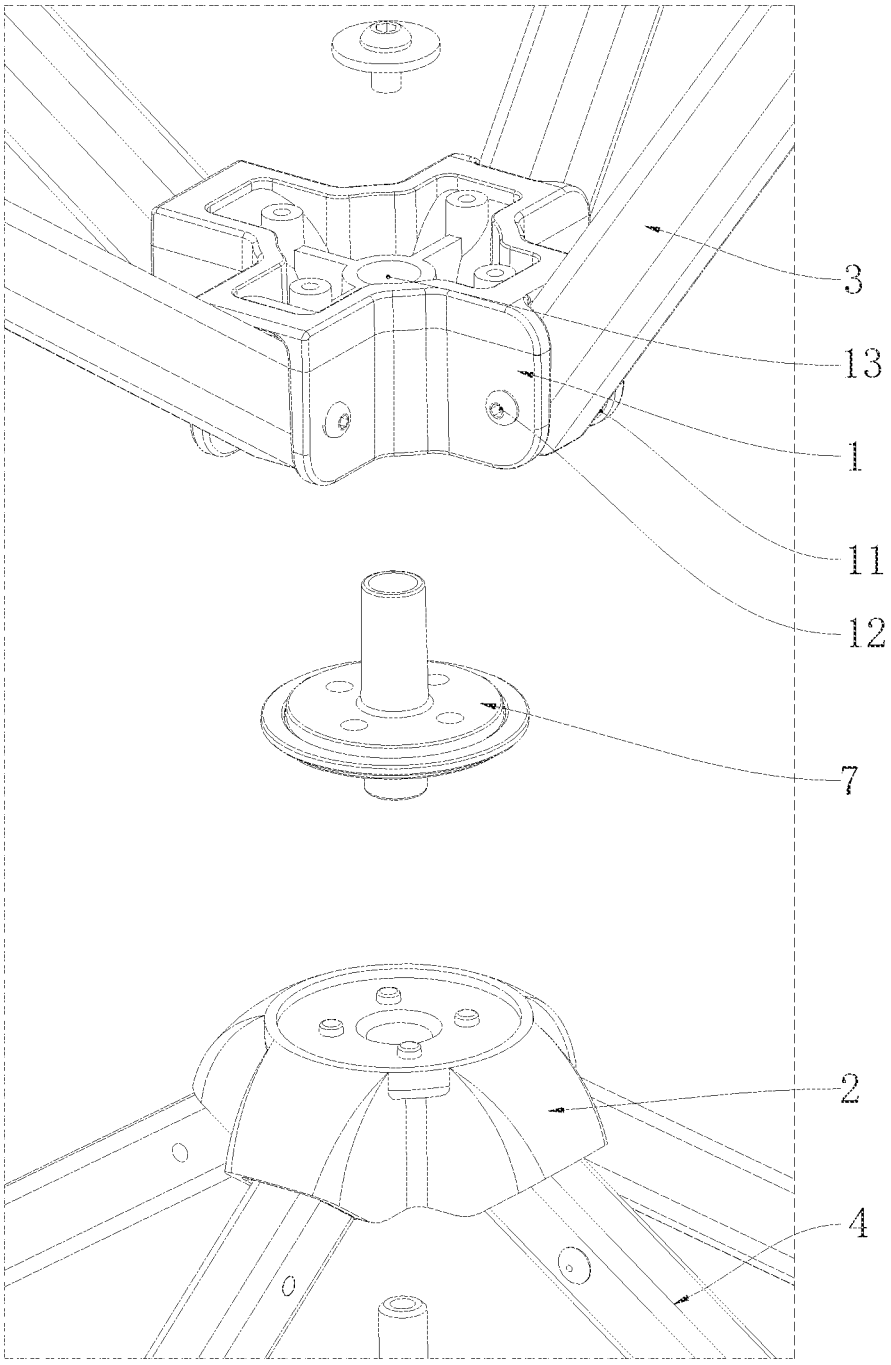
FIG. 4 is a partial structure diagram of the folding chair in FIG. 3.

Specifically, as shown in FIG. 2 to FIG. 4, the upper connector 1 is provided with an upper center hole 13. The lower connector 2 is provided with a lower center hole 23. A connecting shaft 9 runs through the upper center hole 13 and the lower center hole 23, realizing rotatable connection between the upper connector 1 and the lower connector 2. A first immediate connector 7 is provided between the upper connector 1 and the lower connector 2. The first immediate connector 7 includes an upper shaft sleeve 71 connected to the upper connector 1 and a lower shaft sleeve 72 connected to the lower connector 2. The upper shaft sleeve 71 is configured to rotate relative to the lower shaft sleeve 72. The connecting shaft 9 runs through the upper shaft sleeve 71 and the lower shaft sleeve 72.

Specifically, as shown in FIG. 3 to FIG. 4, in this embodiment, the connecting shaft 9 includes a main bolt 91 and an auxiliary bolt 92. The main bolt 91 runs through the lower shaft sleeve 72 and the upper shaft sleeve 71 in sequence from bottom to top until an end of the main bolt 91 extends into an upper part of the upper connector 1. The end of the main bolt 91 is provided with a threaded hole. The auxiliary bolt 92 achieves connection with threads of the main bolt 91 through this threaded hole. The auxiliary bolt 92 is sleeved with a gasket 93.

Furthermore, an upper end of the upper connector 1 forms a mounting slot upon downward depression. The auxiliary bolt 92 is located in the mounting slot and the gasket 93 abuts against a slot bottom of the mounting slot. A cover plate 8 is installed on the upper connector 1. The cover plate 8 seals this mounting slot, in order to prevent the auxiliary bolt 92 from being exposed.

Figure 12:
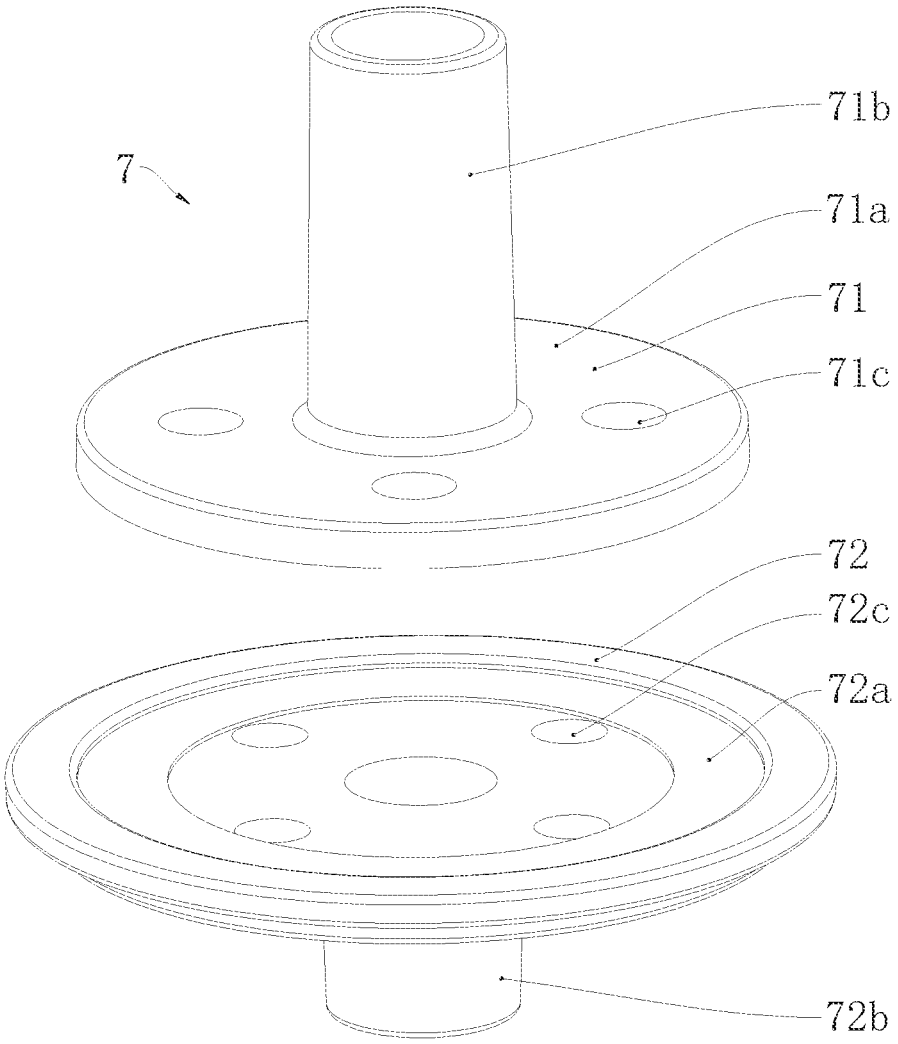
FIG. 12 is a stereogram of a first immediate connector in Embodiment 1 of the present disclosure.

Specifically, as shown in FIG. 12, in this embodiment, the upper shaft sleeve 71 includes an upper flange disk 71*a* and a first shaft sleeve column 71*b* formed by protrusion of the upper flange disk 71*a*. The first shaft sleeve column 71*b* is in rotatable cooperation with the upper center hole 13. The connecting shaft 9 is adapted to the first shaft sleeve column 71*b*. A side, facing to the lower connector 2, of the upper connector 1 is provided with several upper positioning protrusions 14. The upper flange disk 71*a* is provided with upper positioning holes 71*c* corresponding to the upper positioning protrusions 14. The lower shaft sleeve 72 includes a lower flange disk 72*a* and a second shaft sleeve column 72*b* formed by protrusion of the lower flange disk 72*a*. The second shaft sleeve column 72*b* is in rotatable cooperation with the lower center hole 23. The connecting shaft 9 is adapted to the second shaft sleeve column 72*b*. A side, facing to the upper connector 1, of the lower connector 2 is provided with several lower positioning protrusions 25. The lower flange disk 72*a* is provided with lower positioning holes 72*c* corresponding to the lower positioning protrusions 25.

Further, the first shaft sleeve column 71*b* and the second shaft sleeve column 72*b* are coaxially provided, and their inner diameters are equal. An outer diameter of the upper flange disk 71*a* is smaller than an outer diameter of the lower flange disk 72*a*. A circular stepped slot is formed in a disk side, facing to the upper flange disk 71*a*, of the lower flange disk 72*a*. The lower flange disk 72*a* is adapted to a larger circular slot in the circular stepped slot.

Further, as shown in FIG. 8, an upper end of the lower connector 2 forms a circular sunken slot 24 upon downward depression. The lower positioning protrusions 25 are located on a slot bottom of the sunken slot 24, and are evenly distributed along a center axis of the lower connector 2. The outer diameter of the lower flange disk 72*a* is adapted to an inner diameter of the sunken slot 24, so that after the lower flange disk 72*a* is embedded into the sunken slot 24, an upper surface of the lower flange disk 72*a* is flush with the upper end of the lower connector 2.

Further, in this embodiment, the upper flange disk 71*a* and the lower flange disk 72*a* are in surface contact, and both are located between the upper connector 1 and the lower connector 2. Compared to traditional circular bearings, its bearing area is larger, and the stresses borne by the upper flange disk 71*a* and the lower flange disk 72*a* are more even, which can improve the bearing effect of the folding chair.

Embodiment II

Figure 13:
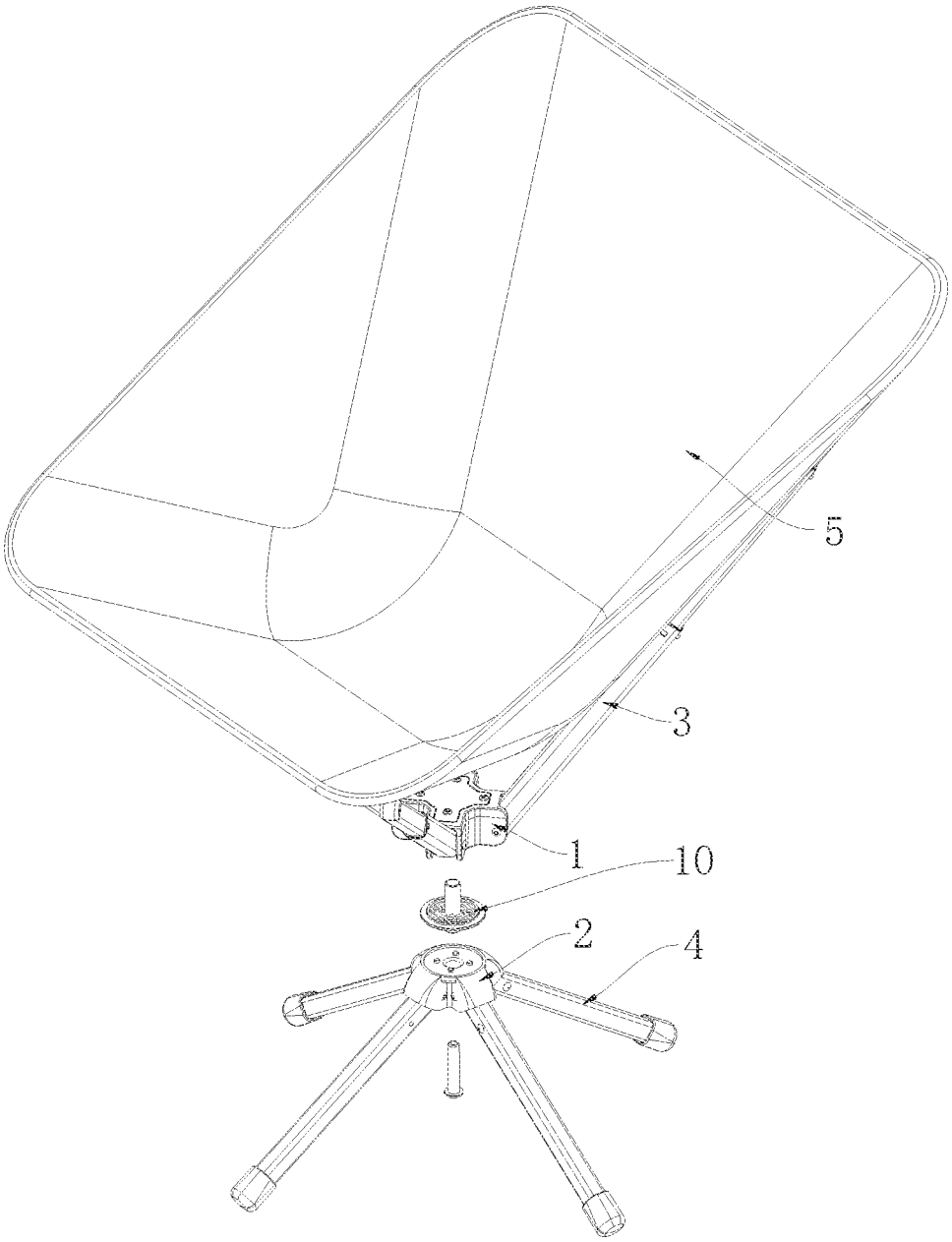
FIG. 13 is an exploded view of the folding chair in Embodiment 2 of the present disclosure.
Figure 14:
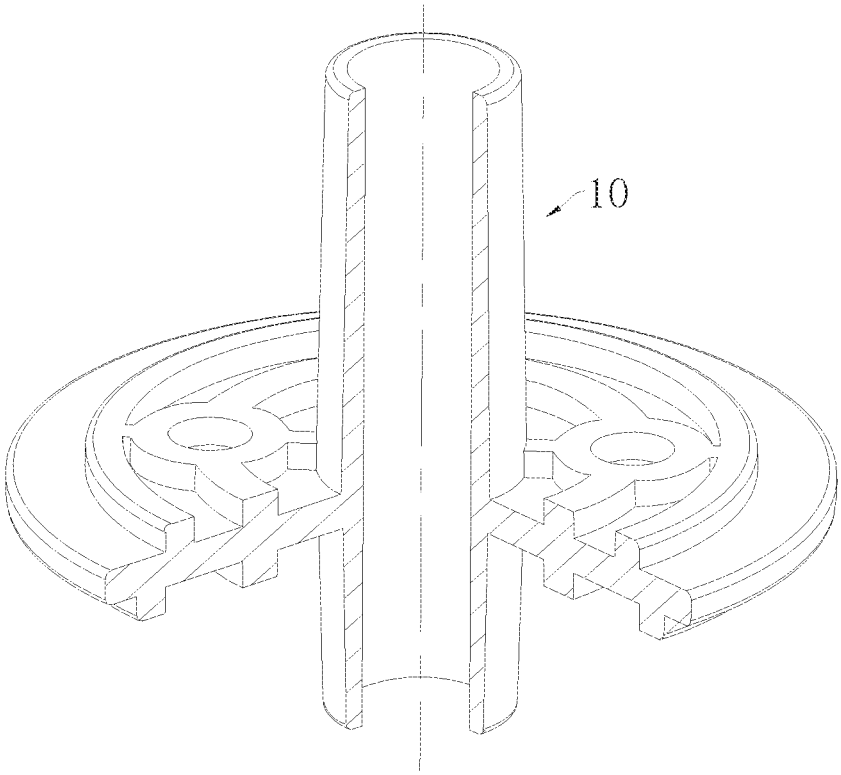
FIG. 14 is a stereogram of a second immediate connector in Embodiment 2 of the present disclosure.
Figure 15:
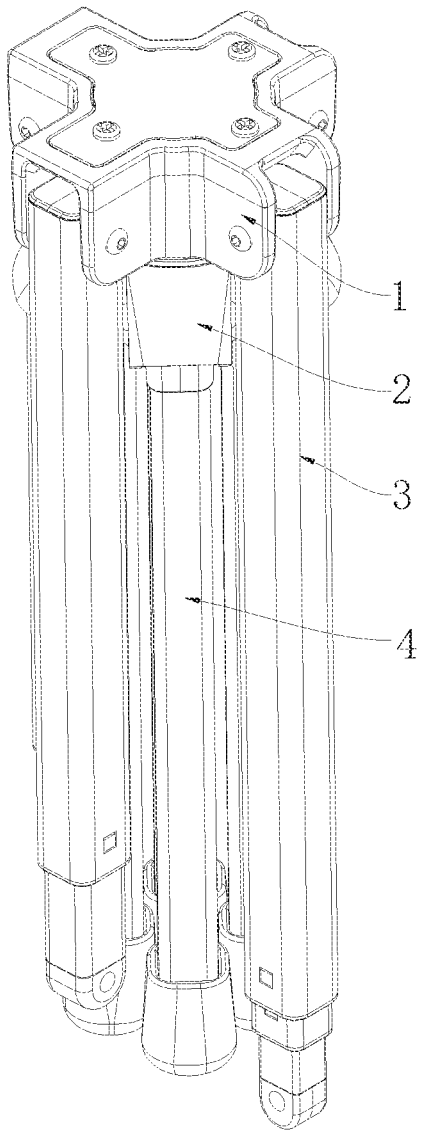
FIG. 15 is a stereogram of the folding chair in Embodiment 2 of the present disclosure folded upon removal of a chair cloth.

As shown in FIG. 13 to FIG. 15, the difference between this embodiment and Embodiment 1 is that in this embodiment, the first intermediate connector 7 in Embodiment 1 is replaced by a second intermediate connector 10. As shown in FIG. 14, in this embodiment, the second intermediate connector 10 includes a disk-shaped flange disk. Upper and lower sides of the flange disk respectively extend outward along the center axis to form shaft sleeve columns, where an axial length of the shaft sleeve column on the upper side is longer than that of the shaft sleeve column on the lower side. An upper surface of the flange disk is provided with a plurality of positioning holes in cooperation with the upper positioning protrusions 14, and a lower surface of the flange disk is provided with a plurality of positioning holes in cooperation with the lower positioning protrusions 25. That is, a part of the second intermediate connector 10 itself relatively rotates, which results in the folding chair using the second intermediate connector 10 in this embodiment not having the function of a rotating chair.

In the description of the present disclosure, it should be understood that the orientations or positional relationships indicated by terms including "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential" are the orientations or positional relationships based on the drawings. The orientations or positional relationships are only for the convenience of describing the present disclosure and simplifying the description, and do not indicate or imply that the device or element referred to necessarily have specific orientations, are constructed and operated in specific orientations, and therefore cannot be understood as limiting the present disclosure.

In addition, terms "first" and "second" are only used for descriptive purposes, and cannot be understood as indicating or implying relative importance or implicitly indicating the number of indicated technical features. Thus, features defined by "first" and "second" may explicitly or implicitly include at least one of these features. In the description of the present disclosure, "a plurality of" means at least two, such as two and three, unless otherwise clearly and specifically defined.

In the present disclosure, unless otherwise clearly stated and defined, terms including "installation", "connected to", "connection" and "fixation" should be understood in a broad sense. For example, it can be fixed connection or detachable connection, or integration. It can be mechanical connection, electrical connection or communication with each other. It can be direct connection or indirect connection through an intermediate media. It can be internal communication of two elements or interaction between two elements, unless otherwise clearly defined. For those of ordinary skill in the art, the specific meanings of the above terms in the present disclosure can be understood according to specific circumstances.

Although the embodiments of the present disclosure have been shown and described above, it can be understood that the above embodiments are exemplary, and cannot be construed as limitations on the present disclosure. Those of ordinary skill in the art can make changes, modifications, substitutions and variations to the above embodiments within the scope of the present disclosure.

What is claimed is:

1. A folding chair, comprising:

an connector (1);

a lower connector (2);

a plurality of upper connecting rods (3) connected to the upper connector (1);

a plurality of lower connecting rods (4) connected to the lower connector (2); and a chair cloth (5), a plurality of cloth corners (51) of the chair cloth (5) being connected to free ends (31) of the upper connecting rods (3) respectively;

wherein the lower connector (2) has a same number of lower open slots (21) as the number of the lower connecting rods (4), and the lower open slot (21) is provided with a stop protrusion (22) in a protuberant manner and provided with a positioning portion (21*a*) in a depressing manner inside; and the lower connecting rod (4) comprises a rod body (41) and a stopper (44) elastically installed on an upper end of the rod body (41), when the folding chair is in an unfolded state, a slope (44*b*) of an upper end of the stopper (44) abuts against a sidewall (22*a*) of the stop protrusion (22), and when the folding chair is in a folded state, a top end (44*c*) of the stopper (44) is clamped into the positioning portion (21*a*).

2. The folding chair according to claim 1, wherein the upper lower connecting rod (4) further comprises a hollow connecting arm (42), the connecting arm (42) is embedded into the rod body (41), and the stopper (44) is installed in the connecting arm (42) in a slidable manner.

3. The folding chair according to claim 2, wherein the rod body (41) is connected to a first stop pin (45), the first stop pin (45) runs through the connecting arm (42), and a spring (43) is provided between a part of the first stop pin (45) inside the connecting arm (42) and the stopper (44).

4. The folding chair according to claim 2, wherein the rod body (41) is provided with a second stop pin (46), and the second stop pin (46) runs through the connecting arm (42); the stopper (44) is transversely formed with a strip-type slide hole (44*a*), and a part of the second stop pin (46) inside the connecting arm (42) is in slidable cooperation with the strip-type slide hole (44*a*).

5. The folding chair according to claim 1, wherein the upper connector (1) is provided with an upper center hole (13), the lower connector (2) is provided with a lower center hole (23), and a connecting shaft (9) runs through the upper center hole (13) and the lower center hole (23), realizing fixed connection or rotatable connection between the upper connector (1) and the lower connector (2).

6. The folding chair according to claim 5, wherein a first immediate connector (7) is provided between the upper connector (1) and the lower connector (2), the first immediate connector (7) comprises an upper shaft sleeve (71) connected to the upper connector (1) and a lower shaft sleeve (72) connected to the lower connector (2), the upper shaft sleeve (71) is configured to rotate relative to the lower shaft sleeve (72), and the connecting shaft (9) runs through the upper shaft sleeve (71) and the lower shaft sleeve (72).

7. The folding chair according to claim 6, wherein the upper shaft sleeve (71) comprises an upper flange disk (71*a*) and a first shaft sleeve column (71*b*) formed by protrusion of the upper flange disk (71*a*), the first shaft sleeve column (71*b*) is in rotatable cooperation with the upper center hole (13), and the connecting shaft (9) is adapted to the first shaft sleeve column (71*b*).

8. The folding chair according to claim 7, wherein a side, facing to the lower connector (2), of the upper connector (1) is provided with several upper positioning protrusions (14), and the upper flange disk (71*a*) is provided with upper positioning holes (71*c*) corresponding to the upper positioning protrusions (14).

9. The folding chair according to claim 6, wherein the lower shaft sleeve (72) comprises a lower flange disk (72*a*) and a second shaft sleeve column (72*b*) formed by protrusion of the lower flange disk (72*a*), the second shaft sleeve column (72*b*) is in rotatable cooperation with the lower center hole (23), and the connecting shaft (9) is adapted to the second shaft sleeve column (72*b*).

10. The folding chair according to claim 9, wherein a side, facing to the upper connector (1), of the lower connector (2) is provided with several lower positioning protrusions (25), and the lower flange disk (72*a*) is provided with lower positioning holes (72*c*) corresponding to the lower positioning protrusions (25).

* * * * *